United States Patent [19]

McGhie

[11] 4,454,952

[45] Jun. 19, 1984

[54] MEANS OF REMOVABLY MOUNTING AN OUTRIGGER

[75] Inventor: James R. McGhie, Brampton, Canada

[73] Assignee: American Hoist & Derrick Company, St. Paul, Minn.

[21] Appl. No.: 402,014

[22] Filed: Jul. 26, 1982

[51] Int. Cl.[3] ..... B66C 23/62

[52] U.S. Cl. ..... 212/189; 280/766.1

[58] Field of Search ..... 212/125, 189; 280/263.1, 264.1, 265.1, 266.1; 248/354 H

[56] References Cited

U.S. PATENT DOCUMENTS

| | | | |
|---|---|---|---|
| 3,084,953 | 4/1963 | McGregor | 280/764.1 |
| 3,836,012 | 9/1974 | Grider et al. | 212/189 |
| 3,937,337 | 2/1976 | Irving | 280/763.1 |
| 4,165,005 | 8/1979 | Jokinen | 280/763.1 |
| 4,276,985 | 7/1981 | Newman | 212/177 |

*Primary Examiner*—Trygve M. Blix

*Assistant Examiner*—Stephen P. Avila

*Attorney, Agent, or Firm*—Stanley E. Johnson; Richard J. Hicks

[57] ABSTRACT

An outrigger assembly for mobile cranes wherein a roller and rail system is provided associated respectively with the outrigger mounting assembly and chassis of the vehicle to facilitate removal of the outrigger assembly from below the vehicle. The outrigger mounting assembly has rollers mounted on opposite sides thereof for the rolling along rails extending transversely across the vehicle at a position below the chassis thereof. Three roller units are mounted on the mounting assembly, two roller units being an upper set for rolling on the upper surface of the rails and the other being a lower unit for engaging the undersurface of the rails. The three sets of roller units are spaced apart from another longitudinally along the length of the mounting assembly, the lower roller unit being disposed adjacent one end of the outrigger mounting assembly.

5 Claims, 7 Drawing Figures

MEANS OF REMOVABLY MOUNTING AN OUTRIGGER

FIELD OF INVENTION

This invention relates generally to mobile cranes, spar trees and the like having outriggers mounted thereon and more particularly to an improved mounting for the removably mounted outrigger assembly located below the undercarriage of the frame.

BACKGROUND OF INVENTION

Mobile cranes, spar trees and the like have outriggers thereon for stabilizing the vehicle during work at the site. The outriggers are removably mounted so they can be detached when moving from one site to another. As the outriggers are extremely heavy this substantially reduces the weight of the mobile crane and can make the difference of complying or not complying with road weight restrictions imposed by various jurisdictions.

One set of two sets of outriggers generally used is normally disposed somewhere between the front and rear wheels of the vehicle and are detachably connected to the frame of the vehicle. The outriggers extend transversely across the vehicle and when detached are lowered onto the ground. Thereafter, the set of outriggers under the vehicle must be pulled out from under the vehicle. Since outriggers weigh several thousands of pounds, it is difficult to slide them from under the vehicle.

PRIOR ART

The problem of removing the front outrigger unit from beneath a mobile crane is addressed in U.S. Pat. No. 3,836,012 issued Sept. 17, 1974 to L. D. Grider. The patent discloses pivoting one of the jack units so it doesn't interfere during removal of the outrigger and including ground engaging wheels on the outrigger to facilitate rolling it from under the chassis of the crane. Theoretically the ground engaging wheels should help considerably, but practically are of little value because of rough ground surface conditions normally present at the work site.

SUMMARY OF INVENTION

It is an object of the present invention to provide an improvement in the mounting of the outrigger below the vehicle so that the outrigger may be readily slid thereunder and out from thereunder permitting using the lifting device of the crane itself to mount and demount the outrigger. This is accomplished in the present invention by providing rails on the frame of the vehicle that co-operate with rollers on the removable outrigger, thus providing a guideway so that the outrigger assembly can be readily rolled under the vehicle and out from under the vehicle.

BRIEF DESCRIPTION OF THE DRAWINGS

The invention is illustrated by way of example in the accompanying drawings wherein.

DESCRIPTION OF PREFERRED EMBODIMENT

Figure 1:
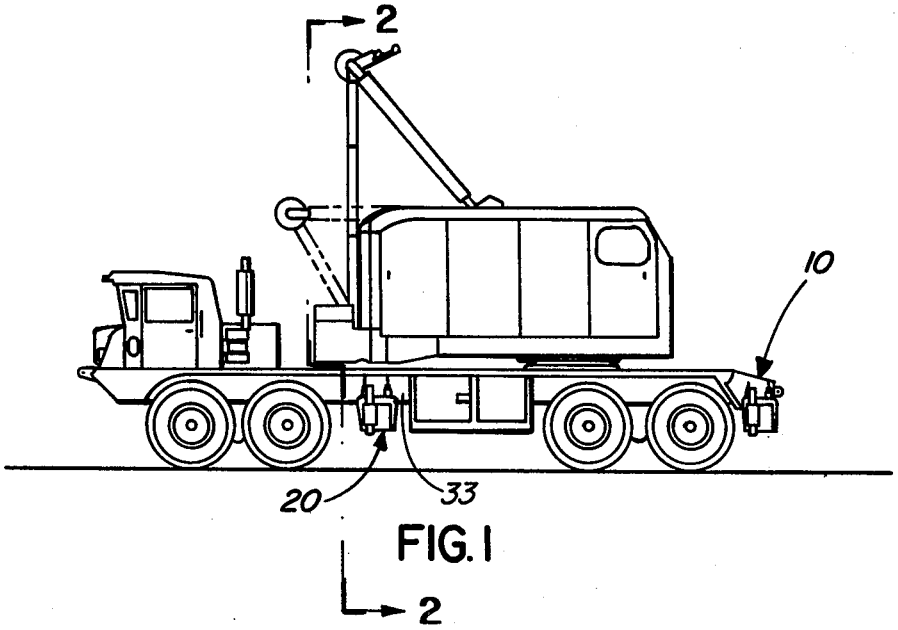
FIG. 1 is a side elevational view of a mobile crane having outriggers mounted thereon.
Figure 2:
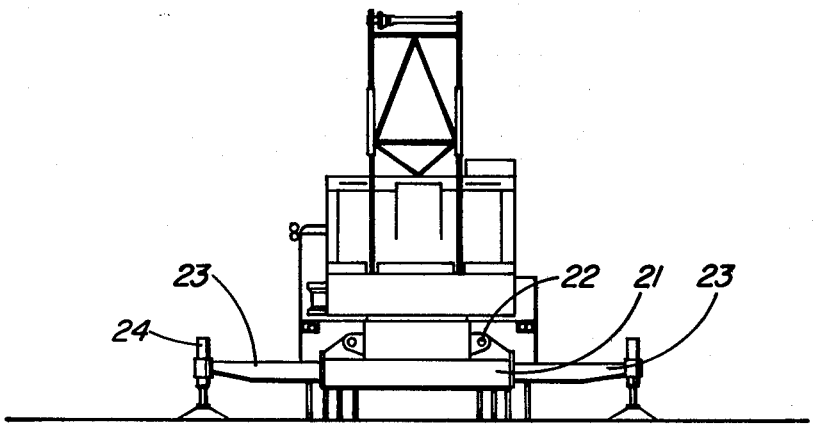
FIG. 2 is a view taken essentially along line II—II of FIG. 1.

Referring to FIGS. 1 and 2 there is illustrated a mobile crane having respective rear and front outrigger assemblies 10 and 20 detachably mounted thereon. The present invention concerns only the outrigger assembly 20 mounted beneath the chassis of the vehicle and located at some position between the respective front and rear wheels of the carrier. The outrigger assembly 20 consists of an outrigger mounting assembly 21 detachably connected to the frame of the carrier by a pair of pins 22, a pair of outrigger arms 23 telescopically mounted in the mounting assembly 21 and projecting outwardly therefrom laterally to opposite sides of the vehicle and a pair of jack units 24.

The pair of outrigger arms 23 are slidable in respective ones of the boxed-shaped channels 25 and 26 in the outrigger support 21. In removing the outrigger 20 from the vehicle for traveling from one site to another outrigger arms 23 are first removed from the outrigger support 21. A lifting unit of some nature is used to lift and support the outrigger support 21 while the pins 22 are removed and the outrigger support is thereafter lowered onto the ground by the lifting unit.

After the outrigger support has been lowered onto the ground, it is necessary to use some device to pull the same from under the vehicle. To overcome this problem, there is provided in accordance with the present invention, a roller and rail system for supporting the outrigger support 21 at a position below the vehicle frame, but above the ground surface.

Referring now particularly to FIGS. 3–7 inclusive, a pair of rails 31 and 32 are secured to the chassis 33 of the mobile vehicle by respective ones of a pair of plates 34 and 35 extending transversely across the vehicle. The plates are suitably reinforced by gusset plates 36. The rails 31 and 32 are spaced apart from one another and receive therebetween the outrigger support 21, which in turn is provided with upper roller units 37 and 37A (the rollers of each being located on opposite sides of the support) and a lower roller unit unit 38. As will be seen from FIGS. 3, 5 and 6, the rails 31 and 32 extend transversely across the vehicle frame and spaced downwardly therefrom, and at least one is provided at one end thereof with a roller stop 39.

Figure 3:
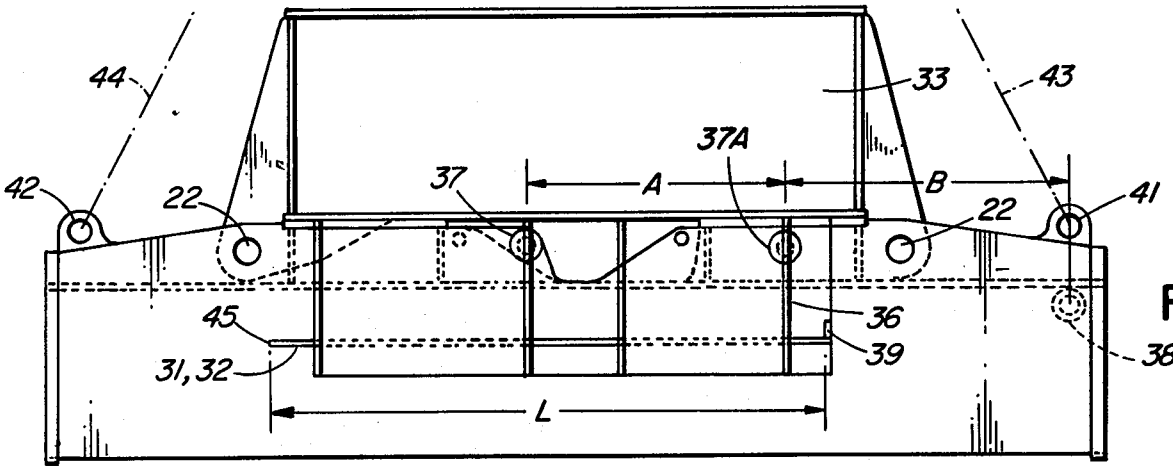
FIG. 3 is similar to FIG. 2, but with the outrigger arms removed from the mounting therefore and illustrating the slide system for the outrigger mounting provided in accordance with the present invention and with the outrigger frame raised and attached to the frame of the mobile vehicle.
Figure 4:
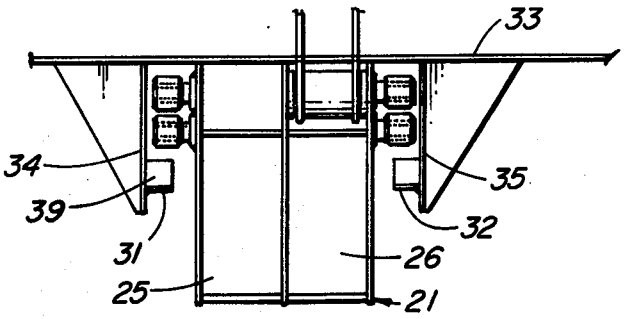
FIG. 4 is a left-hand side elevational view of FIG. 3.

When the outrigger support 21 is in the raised operative position attached to the vehicle frame by pins 22 the rollers 37 and 37A are closely adjacent, but spaced downwardly from the lower edge of the vehicle frame at a position above the tracks 31 and 32 as will be seen from FIG. 3. The pair of rollers of roller unit 37A (i.e., one on each of opposite sides of the outrigger support) are located near the end of the rails 31 and 32 having the roller stop 39 thereat. Roller unit 37 on the other hand is located in the vicinity of the center line of the vehicle. Roller unit 38 is near the outer end of the outrigger support 21 at a position substantially beyond the end of rails 31 and 32.

Figure 5:
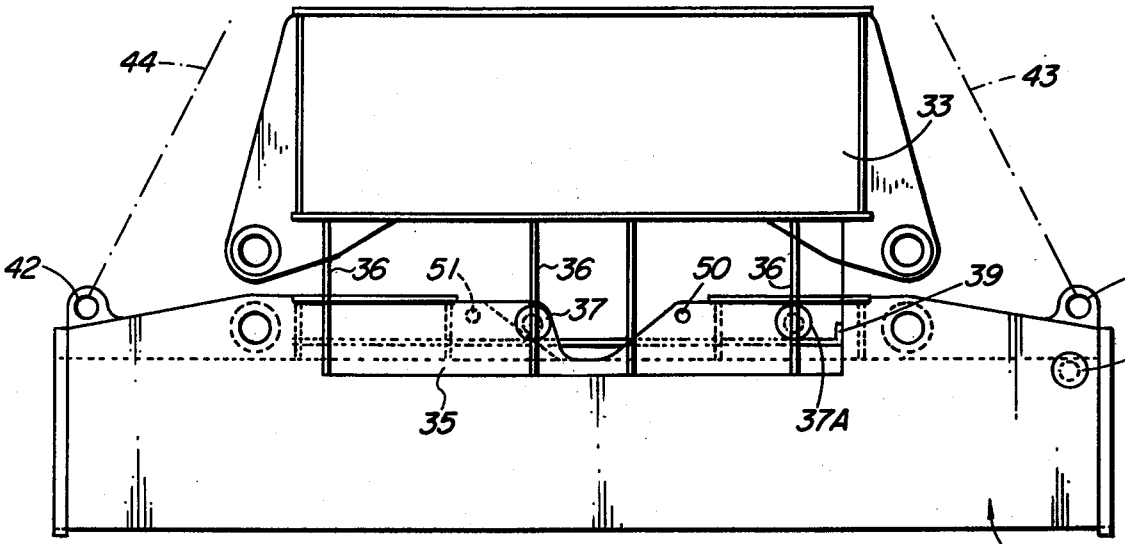
FIG. 5 is a view similar to FIG. 3, but illustrating the outrigger mounting lowered into the slide position for removal from under the vehicle.
Figure 7:
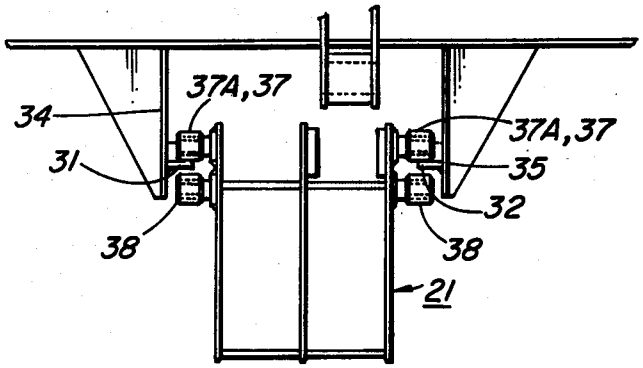
FIG. 7 is a left-hand side elevational view of FIGS. 5 and 6.

The outrigger support has apertured lugs 41 and 42 located respectively at opposite ends thereof on the underside of the outrigger support. To remove the outrigger support 21, a pair of cables 43 and 44, suspended from the lifting hook of the crane, are attached to the apertured lugs 41 and 42, whereafter fastening pins 22 are removed. The lift mechanism is then used to lower the outrigger support 21 to the position where the rollers of the pair of upper roller units 37 and 37A rest on respective ones of the slide rails 31 and 32. Cable 43 is then detached from lug 41 whereafter the entire outrigger support 21 can readily be pulled by hand to the left, as viewed in FIG. 3 with the rollers of the upper roller units 37 and 37A running on the respective rails. The spacing of the roller units 37 and 37A, designated A in FIG. 3, the spacing between roller units 37A and 38, designated B, and the length of the rails, designated L, is arranged such that before the rollers of roller unit 37 reach the end 45 of the rails 31 and 32, the rollers of roller unit 38 are located below the respective rails 31 and 32. Initially before removing the outrigger support after it has been lowered as seen in FIG. 5, the outrigger support is carried by the upper pair of roller units 37 and 37A riding on the upper surface of the pair of rails 31 and 32. As it is moved to the left, as viewed in the drawings, before the rollers of roller unit 37 disengage the rails, the rollers of roller unit 38 engage the undersurface of the rails. Further movement of the outrigger support to the left is then carried by the roller units 37A and 38.

Figure 6:
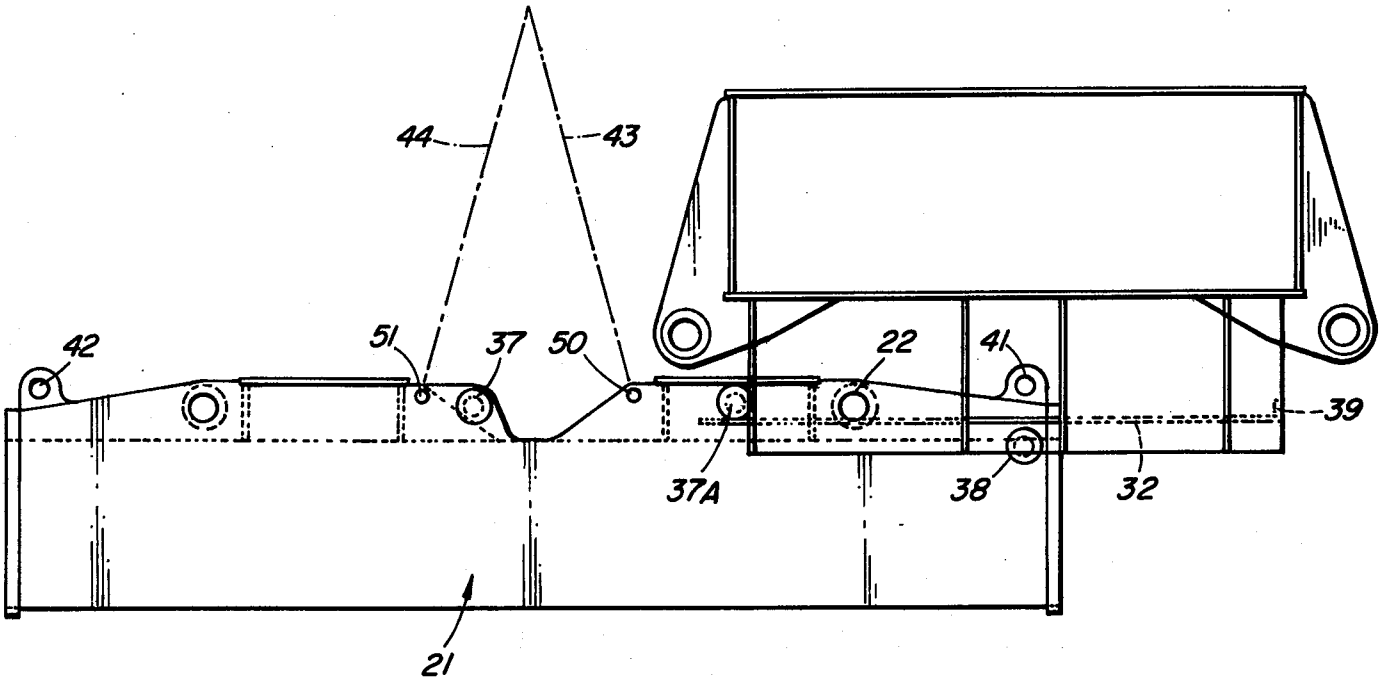
FIG. 6 illustrates the outrigger mounting moved partially from under the vehicle to a position where it can be lifted by the lifting mechanism on the crane.

The outrigger support, projecting laterally from the vehicle frame, as viewed in FIG. 6, is finally removed by attaching the cables 43 and 44 to respective spaced apart apertured lugs 50 51 located in the vicinity of the central portion of the outrigger support.

I claim:

1. A removable outrigger assembly for a mobile crane or the like, comprising:

(a) a mounting assembly detachably connectable to the chassis of the mobile crane, and disposed transversely thereacross below the chassis at a position between the front and rear wheels of the vehicle when mounted thereon said assembly being connectable to the chassis by removable pin means;

(b) a pair of outrigger arms slidably mounted on the mounting assembly and projecting outwardly therefrom beyond opposite sides of the vehicle;

(c) a jack unit on the end of each of the outrigger arms; and, (d) a roller and rail system associated with said mounting assembly and the chassis of the vehicle to facilitate removal of the mounting assembly from beneath the vehicle and positioning the same thereunder, said roller system comprising first and second upper roller units and a first lower roller unit on said mounting assembly, said roller units being spaced apart from one another longitudinally along said mounting assembly and each having rollers located on opposite sides of the mounting assembly and a pair of rails secured to the chassis of the vehicle and extending transversely thereacross at a position therebelow, said rails being spaced apart from one another to receive the mounting assembly therebetween and arranged such that the mounting assembly, after removal of the pin means, must be lowered a selected amount below the chassis of the vehicle before the rollers of the first and second upper roller units engage and rest upon the upper surface of the rails for rolling therealong, the rollers of said lower roller unit being positioned so that they engage the undersurface of the rails after the mounting assembly has rolled a selected amount along the rails and before the rollers of the first upper roller unit disengage the same when removing the mounting assembly from beneath the chassis of the vehicle.

2. An outrigger assembly as defined in claim 1, including means adjacent opposite ends of the mounting assembly for attaching thereto cables suspended from a lifting device.

3. An outrigger assembly as defined in claim 2, including further means on the mounting assembly adjacent the central portion thereof for attaching thereto cables suspended from a lifting device.

4. An outrigger assembly as defined in claim 1, where the mounting assembly is box-like in cross-section and wherein the outrigger arms are telescopically mounted therein.

5. An outrigger assembly as defined in claim 1, including a pair of apertures spaced apart from one another for receiving said removable pin means to detachably mount the mounting assembly on the chassis of the mobile vehicle.

* * * * *